United States Patent [19]

Cummings

[11] Patent Number: 4,704,940

[45] Date of Patent: Nov. 10, 1987

[54] COMPUTER KEYBOARD ADAPTOR

[76] Inventor: Darold B. Cummings, 18720 Kornblum Ave., Torrance, Calif. 90504

[21] Appl. No.: 647,440

[22] Filed: Sep. 5, 1984

[51] Int. Cl.[4] ..... G10C 3/12

[52] U.S. Cl. ..... 84/425; 84/423 R; 340/365 VL

[58] Field of Search ..... 84/315, 316, 317, 425, 84/426, 423, 433; 340/365 VL; 434/227; D17/2, 9

[56] References Cited

U.S. PATENT DOCUMENTS

| | | | |
|---|---|---|---|
| 3,358,070 | 12/1967 | Young | 84/424 |
| 4,352,313 | 10/1982 | Ny | 84/1.01 |
| 4,362,934 | 12/1982 | McLey | 84/DIG. 7 |
| 4,448,103 | 5/1984 | Blakely et al. | 84/453 |

OTHER PUBLICATIONS

"Machine Control", *Manufacturing Engineering,* May 1980, pp. 52–53.

"Exploring 64 Sound", *Compute's Gazette,* Selby Bateman, May 1984, p. 20.

*Primary Examiner*—S. J. Witkowski
*Assistant Examiner*—David Warren
*Attorney, Agent, or Firm*—Charles T. Silberberg

[57] ABSTRACT

A device adapted to be removably placed over a computer keyboard which converts the keyboard to the format of a muscial instrument. The computer is programmed such that selected computer keys of the keyboard will synthesize different musical sounds. The device includes a housing and a plurality of first keys and second keys which are pivotally mounted to the housing. The first and second keys are arranged in a row and are accessible through a cutout in the housing. The first and second keys are shaped to simulate piano or organ keys (white and black). The first and second keys are positioned to register with the selected computer keys. Depressing the first and second keys respectfully depresses corresponding computer keys such that playing of a piano or organ is simulated. The device can also employ a second row of keys.

17 Claims, 7 Drawing Figures

COMPUTER KEYBOARD ADAPTOR

FIELD OF THE INVENTION

This invention relates to an adaptor device for a computer keyboard. More particularly, the invention relates to a device which will mechanically convert the computer keyboard format to that of a musical instrument.

BACKGROUND OF THE INVENTION

Personal and home computers have found many uses. One of these uses is to have a computer synthesize music. Thus, a computer can have a sound interface chip to create sounds which are heard through the monitor speaker (or the speakers of a stereo system). The computer can be programmed such that selected computer keyboard keys will correspond to desired sounds. By depressing the selected keys in a particular order, music can be created or composed. However, the educational and entertainment values of this use for a computer have been limited. Using a computer keyboard to simulate or teach the playing of a musical instrument, such as a piano, is simply not realistic. One does not get the feel of the instrument or readily transferable experience of playing the instrument.

Auxilliary keyboard devices have been developed for various purposes. U.S. Pat. No. 4,119,839 to Beckmann et al describes a keyboard mask for a calculator which limits accessibility of the calculator keyboard to a selected group of keys. U.S. Pat. No. 3,825,101 to Wineman discloses an auxilliary keyboard device for a typewriter adapted to provide a 10-key format for the numeral keys of the typewriter. The device uses motion transfer bars to couple certain of its keys to corresponding laterally spaced typewriter keys. It is also known to have an overlay for a computer keyboard having cutouts for the keys of the keyboard. On the overlay is printed information about the functions of the various keys. However, none of these devices relates to converting a computer keyboard format to simulate a musical instrument.

SUMMARY OF THE INVENTION

It is, therefore, an object of the present invention to provide a device to convert a computer keyboard format to simulate a musical instrument.

It is another object of the present invention to provide a device which will work in combination with a computer programmed to produce musical sounds such that the feel and experience of playing a musical instrument is simulated.

It is yet another object of the present invention to provide a device of the type described which will be adapted to be removably placed over the computer keyboard to mechanically convert the format of the keyboard to one which simulates a piano or organ.

Briefly, in accordance with the invention, there is provided an adaptor device for a computer keyboard. The device comprises a rigid housing which is adapted to be removably disposed over the keyboard, a plurality of first keys, and a plurality of second keys. The first and second keys are pivotally mounted to the housing. The first keys are longer than the second keys. The first and second keys are arranged in a row with the second keys spaced from each other by at least one of the first keys. The first and second keys are positioned to register with selected computer keys. With the computer programmed to have selected computer keys synthesize different musical sounds, depressing the first and second keys respectfully depresses corressponding computer keys resulting in the simulation of playing a musical instrument.

Optimally, the musical instrument simulated is a piano (or equivalently, an organ). In this regard, in conjunction with the computer programming and computer keyboard, the first and second keys are specially shaped and positioned relative to each other. If desired, the device can have a second row of keys spaced from and substantially parallel to the first row. The third and fourth keys of the second row would be similar to the first and second keys.

Other objects and advantages of the invention will become apparent upon reading the following detailed description and upon reference to the drawings.

While the invention will be described in connection with the preferred embodiments, it will be understood that it is not intended to limit the invention to those embodiments. On the contrary, it is intended to cover all alternatives, modifications, and equivalents which may be included within the spirit and scope of the invention as defined by the appended claims.

DETAILED DESCRIPTION OF THE INVENTION

Figure 1:
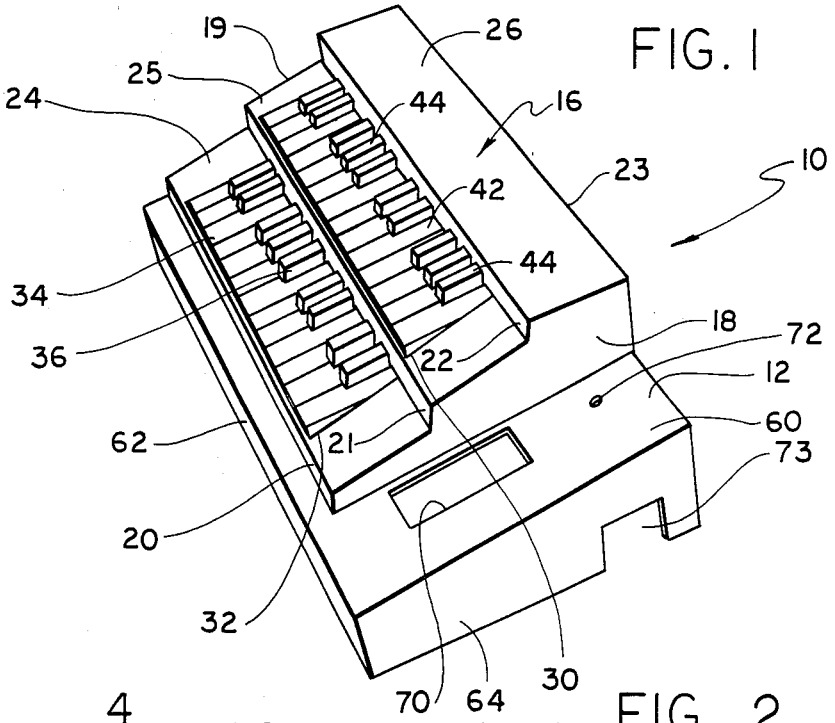
FIG. 1 is a perspective view of a computer keyboard adaptor device according to the present invention having two rows of keys.

Referring now to FIG. 1, there is seen a computer keyboard adaptor device, generally indicated at 10, in accordance with the present invention. Device 10 includes a rigid housing 12 which is shaped so that it can be removably placed over a computer keyboard. The device 10 illustrated in FIG. 1 was designed for the Commodore 64 computer. In this case, the housing 12 fits over the computer 14 which incorporates the keyboard. While not preferred, the device could be designed so that the housing 12 rests on the computer 14 and just covers the keyboard. With some other computers, the keyboard and computer are separate. In such instance, the device would fit only over the keyboard.

Housing 12 includes a raised portion 16 which covers the basic computer keyboard. Portion 16 has side walls 18 and 19, front walls 20, 21, and 22, back wall 23, and top walls 24, 25, and 26. Top wall 26 is higher than wall 25, which is higher than wall 24. Top wall 25 has a lateral slot 30 therein which is substantially perpendicular to side walls 18 and 19. Top wall 24 also has a lateral slot, designated 32, which is substantially parallel to slot 30. In each of slots 30 and 32 are positioned a plurality of keys. The keys in slot 32 are referred to as the first and second keys. The keys in slot 30 are referred to as the third and fourth keys.

Figure 2:
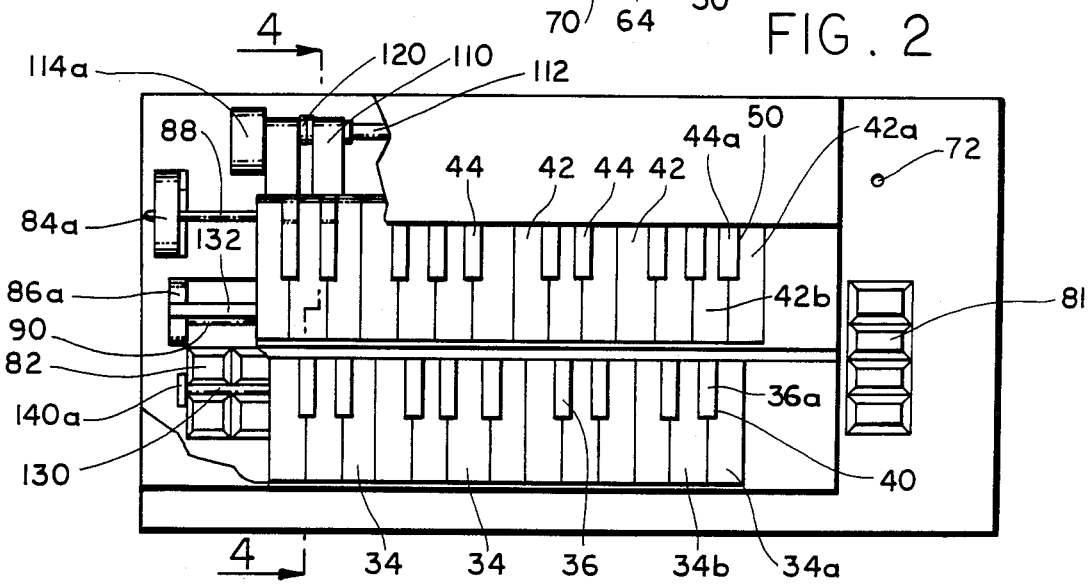
FIG. 2 is a top plan view of the device of FIG. 1 mounted on a computer with a porton of the device broken away.

With further reference to FIG. 2, it can be seen that there are two types of keys in slot 32. The first keys 34 are the ones which extend the full width of the slot 32. The second keys 36 are shorter than the first keys 34 and only extend partially into slot 32. The second keys 36 protrude upwardly from slot 32 and extend above first keys 34. Keys 34 and 36 are arranged in a row with the keys 36 each positioned between two of the keys 34. This is accomplished with each of the keys 36 being respectively positioned in a slot between the adjacent two keys 34. For example, second key 36*a* is in slot 40 between first keys 34*a* and 34*b*. As should now be apparent, the first and second keys 34 and 36 are shaped and positioned to simulate piano (and equivalently organ) keys. In this regard, first keys represent white keys and second keys represent black keys.

A similar explanation applies to the keys in slot 30. The third keys 42 represent the white keys and the fourth keys 44 represent the black keys. Thus, keys 42 extend the full width of slot 30, i.e., from wall 21 to wall 22. Keys 44 extend only partially into slot 30, are shorter than keys 42, and protrude upwardly from slot 30, and extend above keys 42. Keys 42 and 44 are arranged in a row with the fourth keys 44 each positioned in a slot between two of the third keys. This is illustrated in FIG. 2 for a fourth key 44*a* which is in slot 50 between third keys 42*a* and 42*b*.

The row of keys 34 and 36, referred to as the first row, and the row of keys 42 and 44, referred to as the second row, are substantially parallel to each other. However, the second row is positioned above the first row. This is necessary for clearance as will be discussed and for ease of operation, so that the user can use one hand for each row with minimal interference, i.e., one hand would be above the other.

Figure 3:
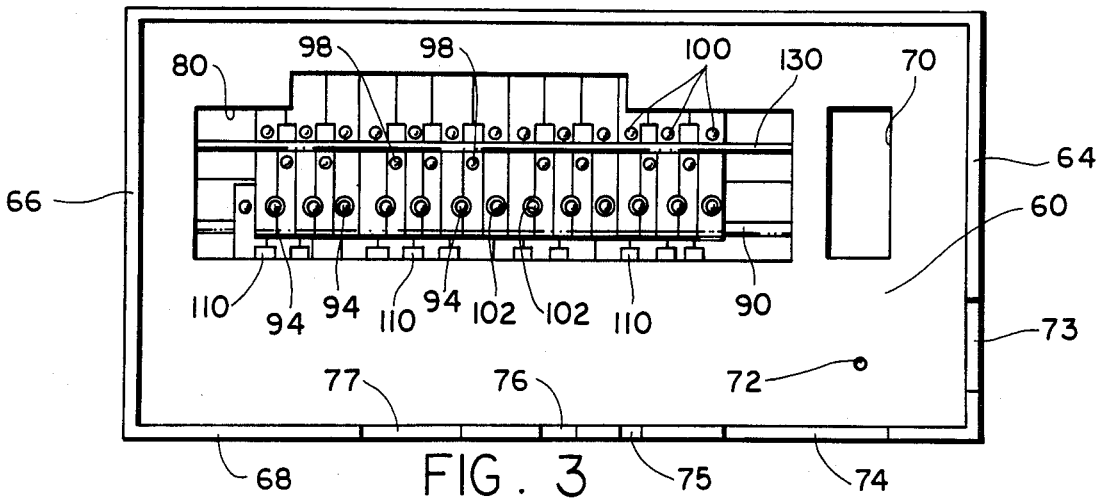
FIG. 3 is a bottom plan view of the device of FIG. 1.

With additional reference to FIG. 3, it can be seen that housing 12 includes a base wall 60 which supports raised portion 16. At the ends of wall 60 are joined four downwardly projecting walls—front wall 62, side walls 64 and 66, and back wall 68. These walls are designed to fit around the computer and to elevate the base wall 60 a measured distance above the computer keyboard (this is illustrated and discussed with reference to FIG. 4). Base wall 60 has a number of cutouts therein. Cutout 70 provides access to keys of the computer keyboard, e.g., function keys 81, that are not part of the basic keyboard. Hole 72 is aligned with the computer power light to make it visible when device 10 is on the computer 14. Cutouts 73, 74, 75, 76, and 77 provide access to various electrical ports of computer 14 when device 10 is on computer 14, such as a control port, power socket, cartridge slot, serial port, cassette interface, etc. Base wall 60 also has a major cutout 80 which is shaped to correspond to the basic computer keyboard. This allows the keys of device 10 access to the computer keyboard keys 82.

With reference to FIGS. 2, 3, 4*a*, and 4*b*, it can be seen how the housing 12 supports the keys of device 10. On base 60 under raised portion 16 and on opposite ends of cutout 80 there are mounted two pair of support members 84*a*, 84*b*, and 86*a* nd 86*b* respectfully. Members 84*a* and 86*a* are close to wall 19 while members 84*b* and 86*b* are close to wall 18. Members 84*a* and 84*b* are in alignment with each other and support a rod 88 which is aligned substantially perpendicular to keys 42 and 44. Each of keys 42 and 44 are pivotally connected to rod 88, preferably by having a transverse bore at one end thereof through which the rod 88 passes. As can be seen, keys 42 and 44 extend from the rod 88, where they are underneath top wall 26, into slot 30 where they are exposed. Similarly, support members 86*a* and 86*b* support a rod 90 which traverses completely across cutout 80 and which is substantially perpendicular to first and second keys 34 and 36. Keys 34 and 36 are pivotally connected to rod 90 in the same manner as keys 42 and 44 to rod 88. Keys 34 and 36 extend from rod 90, where they are underneath and covered by keys 42, into slot 32 where they are exposed.

Figure 4A:
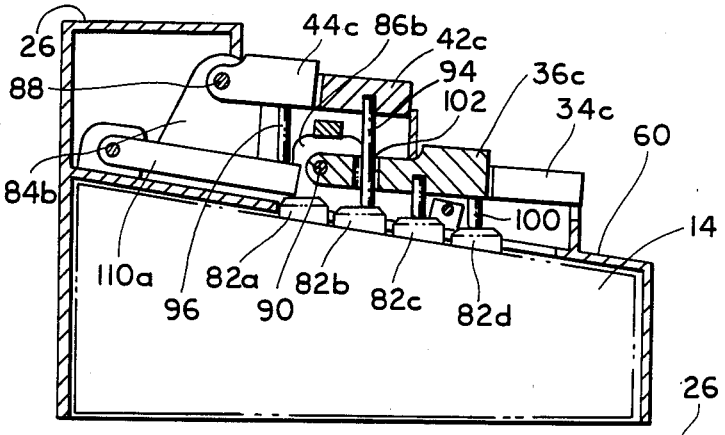
FIG. 4*a* is a cross-sectional view of the device taken along line 4—4 of FIG. 2 with the device keys shown in the unactuated position relative to corresponding computer keys.

Each of keys 34, 36, 42, and 44 have a peg attached to the bottom thereof which projects downwardly toward the computer keyboard 82. Thus, keys 42 have pegs 94, keys 44 have pegs 96, keys 36 have pegs 98, and keys 34 have keys 100. These pegs are for contacting, directly or indirectly, selected computer keys. In this regard, keys 34, 36, and 42 are positioned and dimensioned so that their respective pegs can directly contact respective computer keys of keyboard 82. This also requires that pegs 94, 98, and 100 be attached to keys 42, 36, and 34 to result in the desired contact. This is shown in FIG. 4*a* a first key 34*c* has its peg 100 contact a computer key 82*d*, a second key 36*c* has its peg 98 contact a computer key 82*c*, and a third key 42*c* has its peg 94 contact a computer key 82*b*. As keys 42 overlie a portion of keys 34 and 36, a series of holes 102 is provided in selected keys 34 and 36 to allow pegs 94 to pass through to enable contact with the computer keys which third keys 42 are to register with. In the present embodiment, this resulted in at least a portion of a hole 102 in each the selected keys 34 and 36, i.e., one hole 102 may be entirely in a key 34 while another hole may be half in a key 34 and half in an adjacent key 36.

Fourth keys 44 do not directly contact the computer keys they are designed to register with. Rather, each key 44 contacts a respective extension bar 110. Bars 110 are pivotally connected to a rod 112 in the same manner as keys 42 and 44 to rod 88. Rod 112 is aligned to be substantially parallel to rod 88. Rod 112 is supported at opposite ends to support members 114*a* and 114*b*. Member 114*a* is close to wall 19 while member 114*b* is close to wall 18. The purpose of bars 110 is to retain an even "feel" for keys 34, 36, 42, and 44. Thus, due to space considerations, it was necessary to have the length (lever arm) of keys 44 significantly shorter than the other device keys. It was determined that the device keys had to have a minimum length to retain this "feel." Keys 44 did not meet this requirement. By having keys 44 contact the longer bars 110, which is turn contact the selected aligned computer keys, a uniform "feel" was obtained. Keys 44 and their respective pegs must be positioned to contact respective extension bars 110. Bars 110 are positioned to overlie the selected computer keys which keys 44 are to register with. This is illustrated in FIG. 4*a* where peg 96 on key 44*c* contacts bar 110*a* which in turn contacts computer key 82*a*. Spacers 120 may be required between bars 110 on rod 112 for proper alignment (spacers could also be used if necessary on bars 88 and 90).

Figure 4B:
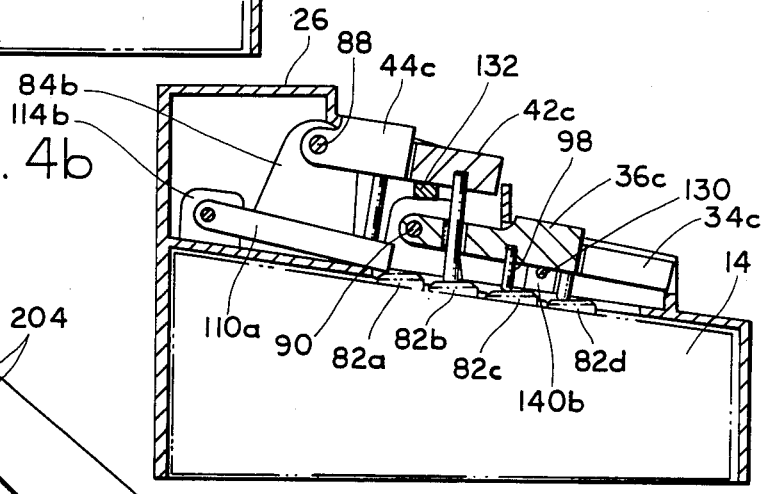
FIG. 4*b* is a cross-sectional view of the device taken along line 4—4 of FIG. 2 with the device keys shown in the actuated or depressed position relative to the corresponding computer keys.

In FIG. 4*a* the keys 34, 36, and 42, are shown in their normal position where they contact (through pegs 100, 98, and 94) but do not depress aligned computer keys. Keys 44 are also in their normal position where they contact (through pegs 96 and bars 110) but do not depress aligned computer keys. In FIG. 4*b* keys 34, 36, 42, and 44 are all depressed, which results in the corresponding computer keys being depressed. In normal practice, only one or two keys would be depressed at one time, e.g., a white key and a black key.

A preferred feature of the present invention is retainer bars 130 and 132. Bar 132 is mounted on members 86*a* and 86*b* underneath keys 42 and extends parallel to rod 90. Bar 132 acts as a stop for the downward movement of keys 42. Bar 130 is mounted on support members 140*a* and 140*b* which are positioned on opposite sides of cutout 80. Bar 130 is positioned underneath keys 34 and 36 and extends parallel to rod 90. Bar 130 acts as a stop for downward movement of keys 34 and 36. Keys 44 have a stop for their downward movement by virtue of the movement of bars 110 being limited by base 60. The advantage of the retainer bars 130 and 132 is that they keep keys 34, 36, and 42 in place when the device 10 is not on computer 14. This in turn makes it easier to place the device on the computer 14 when it is desired to use device 10.

As previously noted, device 10 must be designed for the particular computer or keyboard it is to interface with. Device 10 must also be designed for the software that is to be used with the computer (or vice-versa). The software involved programs the computer such that selected computer keys correspond to various sounds. The computer keys should correspond to device keys such that there is a proper musical relationship, i.e., the order and type of device keys produce the proper sounds. For example, the first and third rows of computer keys could be note keys in proper order and the second and fourth rows of computer keys could be sharps and flats in proper order. Under such circumstances, with device 10 over a properly programmed computer 14, the user would have the feel of playing a piano or organ by virtue of depressing keys simulating those on a piano or organ and hearing the sounds which should correspond to such keys, thereby enhancing the realism and educational and entertainment values of this use of the computer.

Figure 5:
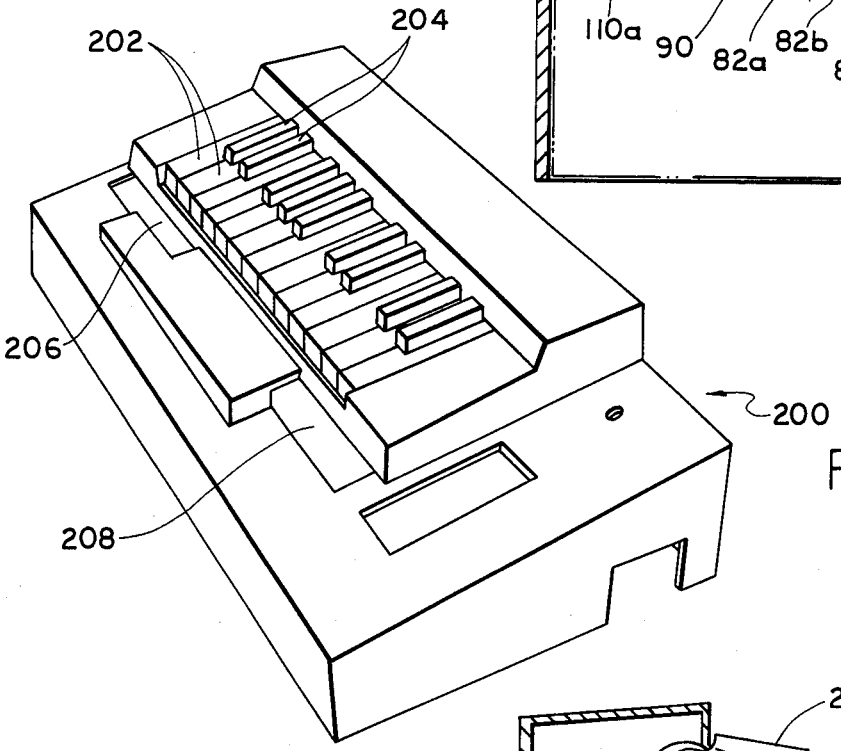
FIG. 5 is a perspective view of a computer keyboard adaptor device according to the present invention having one row of keys.
Figure 6:
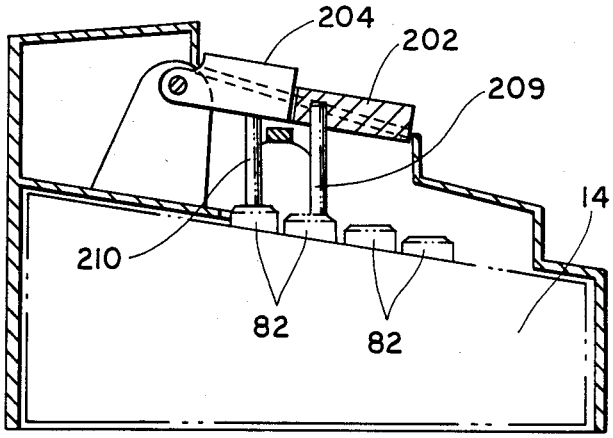
FIG. 6 is a cross-sectional elevational view of the device of FIG. 5 mounted on a computer with the device keys shown in the unactuated position relative to the corresponding computer keys.

FIGS. 5 and 6 illustrate another embodiment of the invention. In this embodiment, the adaptor device 200 has only one row of keys. There are two types of keys-first keys 202 corresponding to white keys and second keys 204 corresponding to black keys. Device 200 has room for additional cutouts 206 and 208 to directly access certain computer keys. Keys which can be directly accessed (whether in device 10 or 200) can be used for various purposes. For example, to change octave, waveform, pitch, number of voices, keyboard mode, keyboard effect, etc. Keys 202 directly contact respective computer keys 82 through pegs 209. Unlike keys 44 of device 10, keys 204 directly contact respective computer keys 82 through pegs 210. Existing software for the Commodore 64 computer which will work with device 200 in accordance with the invention is sold under the name "Music Machine." The software is in cartridge form and can be connected directly to the computer through a slot in the adaptor device housing, e.g., slot 74 in device 10.

Thus, it is apparent that there has been provided, in accordance with the invention, a computer keyboard adaptor that fully satisfies the objectives, aims, and advantages, set forth above. While the invention has been described in conjunction with specific embodiments thereof, it is evident that many alternatives, modifications, and variations will be apparent to those skilled in the art in light of the forgoing description. Accordingly, it is intended to embrace all such alternatives, modifications, and variations which fall within the spirit and scope of the appended claims.

I claim:

1. An adaptor device for a computer comprising:

a computer, said computer having a keyboard;

a rigid housing adapted to be removably disposed over said keyboard, said housing having a base wall which overlies said computer keyboard, said base wall having a cutout therein;

a plurality of first, second, third, and fourth keys pivotally mounted to said housing, said first keys being longer than said second keys, said third keys being longer than said fourth keys, said first and second keys being arranged in a first row, said third and fourth keys being arranged in a second row which is spaced from said first row, said first and second rows being substantially parallel, said second row positioned above said first row, said second keys being spaced from each other by at least one of said first keys, said fourth keys being spaced from each other by at least one of said third keys, said first, second, third, and fourth keys being positioned to register with selected computer keys when said housing is positioned over said keyboard, said cutout providing access to allow said first, second, third, and fourth keys to register with selected computer keys, said first, second, third, and fourth keys having a means for contacting selected computer keys, said first, second, and third keys each having a peg mounted to the bottom thereof which is used for contacting a selected computer key; and a row of holes, said holes passing through selected first and second keys, there being at least a portion of one of said holes in each of said selected first and second keys, a plurality of said pegs of said third keys being aligned with and extending through respective holes, said pegs of said first, second, and third keys being in alignment with said selected computer keys such that depressing said first, second, and third keys will respectively depress corresponding computer keys.

2. The device of claim 1, wherein said cutout is shaped to provide access to the majority of the computer keys of said computer keyboard.

3. The device of claim 1, also including a pluality of bars pivotally connected to said housing, each of said bars being respectfully positioned in alignment with and underneath one of said fourth keys, said fourth keys each having a peg mounted to the bottom thereof which is used for contacting the aligned bar, said bars being in alignment with and able to contact selected computer keys such that depressing said fourth keys will respectfully depress corresponding computer keys.

4. The device of claim 1, wherein said second keys protrude from said housing above said first keys, and said fourth keys protrude from said housing above said third keys.

5. The device of claim 3, wherein said second keys protrude from said housing above said first keys, and said fourth keys protrude from said housing above said third keys.

6. The device of claim 1, wherein each of said second keys are positioned between two of said first keys, each of said second keys respectfully positioned within a slot between the adjacent two first keys, each of said fourth keys are positioned between two of said third keys, each of said fourth keys respectfully positioned within a slot between the adjacent two third keys.

7. The device of claim 3, wherein each of said second keys are positioned between two of said first keys, each of said second keys respectfully positioned within a slot between the adjacent two first keys, each of said fourth keys are positioned between two of said third keys, each of said fourth keys respectfully positioned within a slot between the adjacent two third keys.

8. The device of claim 4, wherein each of said second keys are positioned between two of said first keys, each of said second keys respectfully positioned within a slot between the adjacent two first keys, each of said fourth keys are positioned between two of said third keys, each of said rourth keys respectfully positioned within a slot between the adjacent two third keys.

9. The device of claim 5, wherein each of said second keys are positioned between two of said first keys, each of said second keys respectfully positioned within a slot between the adjacent two first keys, each of said fourth keys are positioned between two of said third keys, each of said fourth keys respectfully positioned within a slot between the adjacent two third keys.

10. The device of claim 9, wherein said housing has a second cutout which allows selected computer keys to protrude therethrough, whereby said protruding computer keys can be depressed while said device is disposed over said keyboard.

11. The device of claim 9, wherein said housing has at least one access slot in alignment with an electrical port on said computer, whereby an electrical connection to said port can be made while said device is disposed over said keyboard.

12. The device of claim 9, wherein said first, second, third, and fourth keys are shaped to simulate piano keys.

13. The device of claim 1, wherein said computer is programmed such that depressing selected computer keys will respectfully produce different musical sounds, and wherein said first, second, third, and fourth keys register with said selected computer keys that produce musical sounds such that depressing said first, second, third, and fourth keys will simulate the playing of a piano.

14. The device of claim 9, wherein said computer is programmed such that depressing selected computer keys will respectfully produce different musical sounds, and wherein said first, second, third, and fourth keys register with said selected computer keys that produce musical sounds such that depressing said first, second, third, and fourth keys will simulate the playing of a piano.

15. The device of claim 1, also including a retainer bar mounted to said housing and positioned beneath said first and second keys which limits the downward rotation of said first and second keys.

16. The device of claim 14, also including a retainer bar mounted to said housing and positioned beneath said first and second keys which limits the downward rotation of said first and second keys.

17. The device of claim 16, also including a second retainer bar mounted to said housing and positioned beneath said third keys which limits the downward rotation of said third keys.

* * * * *